US005104057A

United States Patent [19]

Chesler et al.

[11] Patent Number: 5,104,057

[45] Date of Patent: Apr. 14, 1992

[54] GAS DAMPED FILAMENT DISPENSER

[75] Inventors: Ronald B. Chesler, Woodland Hills, Calif.; Jerome J. Krempasky; James R. Rochester, both of Tucson, Ariz.

[73] Assignee: Hughes Aircraft Company, Los Angeles, Calif.

[21] Appl. No.: 686,081

[22] Filed: Apr. 16, 1991

Related U.S. Application Data

[63] Continuation-in-part of Ser. No. 430,699, Nov. 1, 1989, Pat. No. 5,052,636.

[51] Int. Cl.[5] ..... B65H 49/02; B65H 59/00; F42B 12/68; F42B 15/04

[52] U.S. Cl. ..... 242/128; 242/147 R; 242/156; 242/159; 242/170; 244/3.12

[58] Field of Search ..... 245/128, 54 R, 147 R, 245/147 A, 156, 159, 170, 171, 99; 244/3.12; 226/97

[56] References Cited

U.S. PATENT DOCUMENTS

| | | | |
|---|---|---|---|
| 3,232,557 | 2/1966 | Winn, Jr. | 242/146 |
| 3,286,947 | 11/1966 | Erickson | 242/128 |
| 3,305,150 | 2/1967 | Campbell et al. | 226/97 |
| 3,319,781 | 5/1967 | Simpson et al. | 242/170 X |
| 3,613,619 | 10/1971 | de Nobel | 244/3.12 |
| 4,271,761 | 6/1981 | Canning et al. | 242/128 X |
| 4,326,657 | 4/1982 | Arpin et al. | 242/128 X |
| 4,508,285 | 4/1985 | McMillan | 242/159 |
| 4,903,607 | 2/1990 | Clark | 244/3.12 |
| 4,967,980 | 11/1990 | Pinson | 242/128 X |
| 4,991,793 | 2/1991 | Belsley et al. | 242/128 |

*Primary Examiner*—Stanley N. Gilreath
*Attorney, Agent, or Firm*—R. M. Heald; C. D. Brown; W. K. Denson-Low

[57] ABSTRACT

A missile data link filament (12) dispenser (10) is located within an enclosure (20) having a single eyelet opening (26) through which the filament feeds on launch. A quantity of a damping gas having an effective density of at least about two times that of air (28) is provided within the enclosure (20). The gas serves to damp the helical motion of the filament by absorbing its rotational energy, to inhibit ballooning of the filament (12) as it is paid out from the dispenser (10).

20 Claims, 2 Drawing Sheets

GAS DAMPED FILAMENT DISPENSER

This application is a continuation-in-part of copending application Ser. No. 07/430,699, filed Nov. 1, 1989, now U.S. Pat. No. 5,052,636.

BACKGROUND OF THE INVENTION

1. Field of the Invention

The present invention relates generally to a filament dispenser for a missile or other moving vehicle, and, more particularly, to a filament dispenser which damps transverse oscilltions of the unspooling filament.

2. Description of Related Art

A number of missiles remain interconnected with control apparatus upon launch by a filament, either wire or preferably an optical fiber, via which navigational information is exchanged over at least a part of the missile travel path. These filaments are typically wound into a pack carried on the missile, or other vehicle, and care must be taken in the manner of unspooling the filament (dispensing) to prevent damage to the filament.

One difficulty encountered on dispensing wound filament pack, especially at high speeds, is the tendency for the filament to form helical loops of relatively large amplitude extending transversely to the dispensing direction. Such loops require a correspondingly large exit port for filament dispensing, which is undesirable because the larger exit port increases the drag on the vehicle. Still further, the radar cross-section of the vehicle (i.e., detectability) is accordingly maintained at a size larger than desired. The loops also prevent ducting of dispensed filament prior to release into the ambient airstream.

It is, therefore, highly desirable to provide a filament dispensing technique ideally producing a linear trajectory, allowing dispense from a small exit port. Also, all of this should be accomplished without subjecting the filament to significant risk of damage, destruction or reduction in signal transmission capabilities.

SUMMARY OF THE DISCLOSURE

In accordance with the present invention a wound pack of filament is fixedly mounted within an enclosure secured to the missile or other vehicle. The enclosure has a single small opening (eyelet) through which the filament is dispensed.

Prior to or at launch, the enclosure is filled with a damping gas having an effective density of at least about two times that of air at standard temperature and pressure, to damp the unspooling filament transverse kinetic energy so that linear payout results. Not only are the already referenced advantages obtained, but a linear dispense trajectory is advantageous in enabling avoidance of the rocket plume which could otherwise destroy or damage the filament.

DETAILED DESCRIPTION OF THE INVENTION

Figure 1:
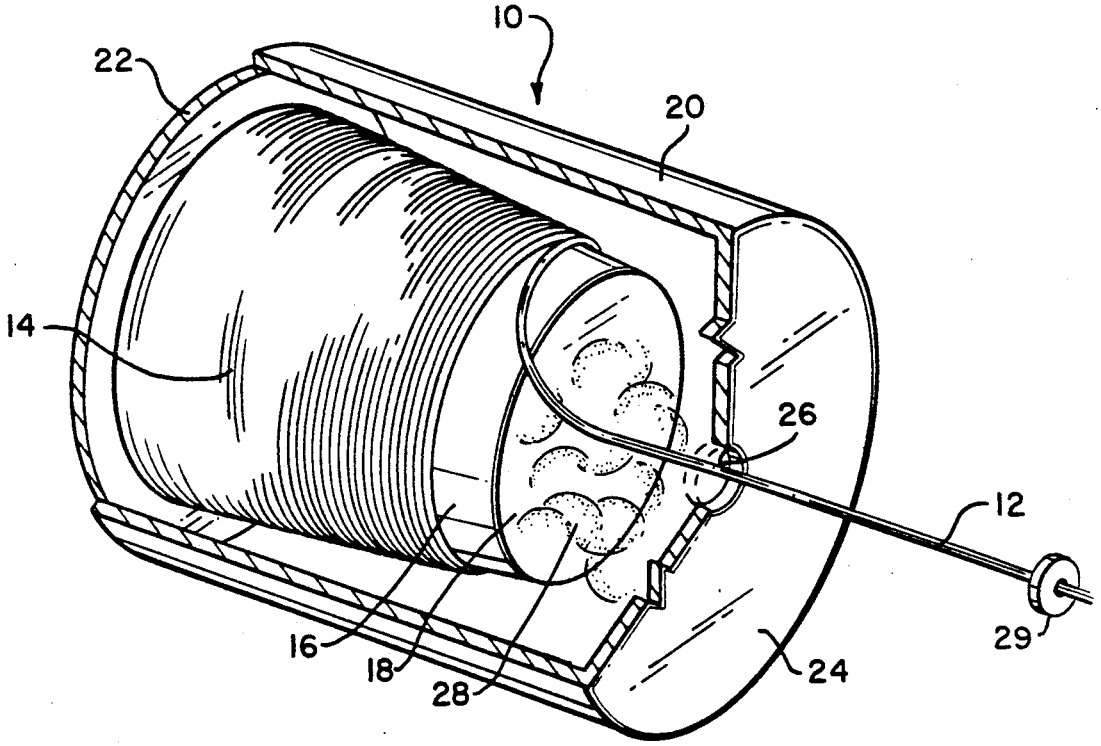
FIG. 1 is a perspective, partially fragmented view of a first form of the invention.

Turning now to the drawings and particularly FIG. 1, the filament dispensing apparatus of the invention is enumerated generally as 10. More particularly, a filament 12 is wound into a pack 14 on a cylindrical drum 16 which is tapered to a relatively small diameter take-off end 18.

A hollow enclosure 20 is cylindrical and of such internal dimensions as to enable coaxially securing the large end of the drum 16 to the closed end wall 22, while at the same time providing space for the filament to be taken off the pack without contacting the enclosure walls. The enclosure end wall 24 opposite the drum small end 18 includes a small opening or eyelet 26 through which the filament 12 passes as it is dispensed.

The outer end of the filament 12 interconnects with apparatus located at the launch site (not shown) while the other end of the filament is similarly connected to on-board apparatus (not shown). Neither of these apparatus nor the connections thereto are shown since they are conventional and detailed understanding is not necessary for a full understanding of this invention.

In one form of the present invention, a quantity of an aerosol powder is openly positioned within the enclosure 20. Immediately upon the filament beginning dispense, the moving filament agitates the aerosol powder causing it to form an aerosol mixture or suspension within the enclosure. The aerosol mixture is sufficiently dense to damp the motion of the filament, reducing the formation of transverse loops. That is, the aerosol mixture provides an aerodynamic drag to the unspooling filament which damps transverse kinetic energy permitting the filament to exit via eyelet 26 along a substantially linear trajectory.

In explanation, it is known that braking of an unspooling filament by contact with a solid surface reduces transverse "ballooning" of the filament. However, such braking is not completely satisfactory in that the filament may be subject to undue abrasion and tensile forces resulting in undesirable bending, kinking, or even severing of the filament. In seeking a substitute for mechanical braking, liquids were considered for use in the enclosure, but all were found to be too dense resulting in excessive filament tensile stress on dispense. It was found that aerosols having an effective density of at least 10 times that of air at standard temperature and pressure are useful in some configurations, while gases having an effective density of at least two times that of air at standard temperature and pressure are useful in other configurations.

An aerosol mixture which consists essentially of very fine solid or liquid particulate matter suspended in a gas has been found to possess the required range of density, namely, greater than that of any gas found but less than that of a liquid.

Although other aerosol materials and amounts may be found advantageous, for an enclosure having an interior 30 cm long and 15 cm in diameter, 300 gms of molybdenum disulfide powder (sold under the trade designation Z-Powder) will be kept air borne within the enclosure by the filament unspooling movement and at the same time provide the desired filament damping.

Although an optimum density has not been determined as yet, it is clear that for some applications an aerosol mixture having a density of no more than 10 times the density of air will be insufficient. On the other hand, an aerosol mixture density exceeding 100 times that of air is too great for filament safety or to insure satisfactory signal transmission.

In another form of the invention that is preferred when less aerodynamic drag and damping is required, the interior of the enclosure 20 is filled with a damping gas, indicated generally by numeral 28. The effective density of the gas 28 must be at least two times that of air, when the air is measured at standard pressure and temperature, or insufficient damping results.

In order to understand this aspect of the present invention, it is important to define and distinguish between the "effective density" and the "STP density" of a gas, as those terms are used herein. The term "STP density" of a gas is used herein to means its density at standard temperature (0° C.) and pressure (760 millimeters). The term "effective density" of a gas is used herein to mean its density measured at the existing condition of temperature and pressure of the gas. To a good approximation, the "effective density" of a gas is proportional to the product of its STP density times its normalized pressure at standard temperature. Thus, for example, an effective density of five times that of air at standard temperature and pressure can be achieved by providing a damping gas with an STP density of five times that of air, the damping gas having a pressure of one atmosphere, or by providing a damping gas with an STP density equal to that of air (such as air itself) but pressurized to five atmospheres, or any combination of STP density and pressure that is equivalent.

In the version of the dispenser 10 shown in FIG. 1, the enclosure 20 is filled with a static damping gas 28 having an STP density of more than twice that of air, maintained at atmospheric pressure equal to that of the ambient atmosphere in which the dispenser 10 resides. Prior to the use of the dispenser 10, a plug 29 is initially fitted to the opening 26. The plug 29 has an opening therein through which the end of the filament 12 passes to the exterior of the dispenser 10. The plug 29 fits snugly into the opening 26 and around the filament 12, but need not be capable of sealing under conditions of large pressure differences.

When dispensing begins, the plug 29 is pulled out of the opening 26 to permit the filament 12 to be dispensed through the opening 26. (FIG. 1 illustrates the dispenser 10 just after the plug 29 has been pulled from the opening 26 as dispense begins.) Since the damping gas 28 is at about one atmosphere pressure, there is only minor driving force for the damping gas to flow out of the interior of the enclosure 20 through the opening 26. The damping gas therefore remains within the enclosure 26 for the duration of the dispense. The damping effect is attained in this case by the high STP density of the damping gas, in turn resulting from a molecular weight greater than that of air. In a preferred embodiment, the damping gas has a molecular weight and a density at least five times that of air when measured at standard temperature and pressure. One such preferred damping gas is sulfur hexafluoride ($SF_6$). An example of another such damping gas is bromotrifluoromethane ($CBrF_3$), also sometimes identified as R1381.

Figure 2:
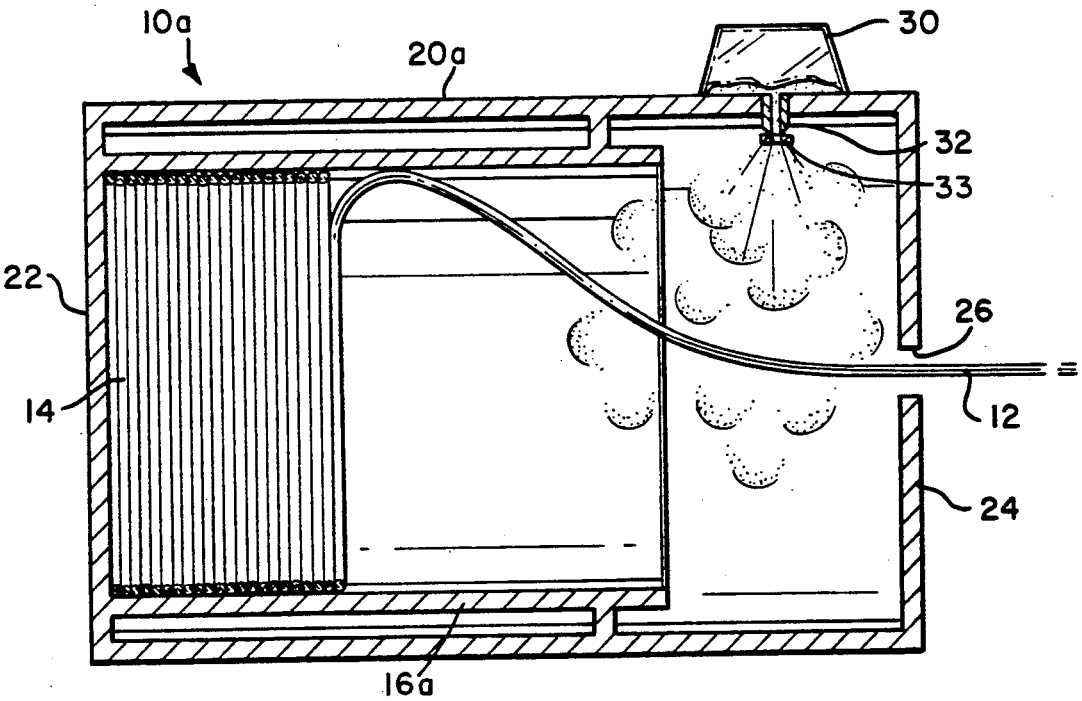
FIG. 2 is a side sectional view of an alternative embodiment.

As an alternative embodiment shown in FIG. 2, the filament dispensing apparatus **10*a* is constructed such that a flowing atmosphere of the damping gas 28 can be supplied from a pressurized source 30 and selectively injected into the enclosure 20*a* via a nozzle 32. The interior of the enclosure 20*a* becomes pressurized with the damping gas. To ensure that the interior of the enclosure 20*a* is sealed against penetration of air during storage, the enclosure 20*a* may be initially filled with damping gas at one atmosphere pressure and the opening 26 sealed with a plug as previously discussed. When dispensing is to occur, the interior of the enclosure 20*a*** is pressurized with the damping gas, and the plug pulled out as the dispense begins.

The results obtained with the approach of FIG. 2 are substantially the same as in the first described embodiment with respect to damping capability, but are achieved through pressurizing the damping gas. Moreover, the approach of FIG. 2 may be required for dispensers in which a very large amount of filament is dispensed, and the approach of FIG. 1 might lose effectiveness toward the end of the dispense because the damping gas diffuses out of the enclosure 20 through the opening 26. The approach of FIG. 2 is also effective when the payout of filament is from the interior of the drum **16*a***, as illustrated.

When a flowing atmosphere of the damping gas i utilized, the nozzle 32 is designed so that it does not introduce a swirling motion into the damping gas in the direction of the dispensing of the filament 12, or introduces a counterflow movement in the gas that serves to damp the helical motion of the filament. In some prior designs, such as that shown in U.S. Pat. No. 4,326,657, a swirling motion of gas within the dispenser was thought to be desirable, and a swirling motion to encourage helical movement was specifically introduced through nozzle design. Completely to the contrary, in the present approach the gas introduced into the interior is a damping gas intended to reduce transverse motion of the filament within the dispenser, not encourage it as by swirling the filament in the direction that increases the helical movement. In one embodiment of the present invention, the damping gas 28 in introduced in a counterflow manner, with the damping gas flowing in a direction counter to the rotation of the filament so as to inhibit and reduce its helical movement.

Any effective technique to avoid swirling of the damping gas 28 can be used in the present approach. One technique is to mount the nozzle 32 on the side of the enclosure 20 rather than coaxially with the dispensing axis. Another is to use a diffuser plate 33 having small openings therein to reduce the kinetic energy of the damping gas as it flows from the nozzle. The openings through which the damping gas flows from the nozzle 32 are preferably positioned and oriented to direct the gas flow in a direction opposite to the helical movement of the filament 12 as it unwinds from the cylindrical drum 16, thereby using any kinetic energy in the gas to reduce, rather than accentuate, the helical movement.

FIG. 2 shows application of the invention to a filament canister **16*a* constructed for inside payout which is advisable for certain uses. The flowing atmosphere of damping gas may be utilized with this type of dispenser, or with the embodiments of FIG. 1 or FIG. 3**. Studies have shown that, in many instances, the use of a damping gas is most advantageously applied to an inside payout canister, while the use of an aerosol is most advantageously applied to an outside payout canister.

Figure 3:
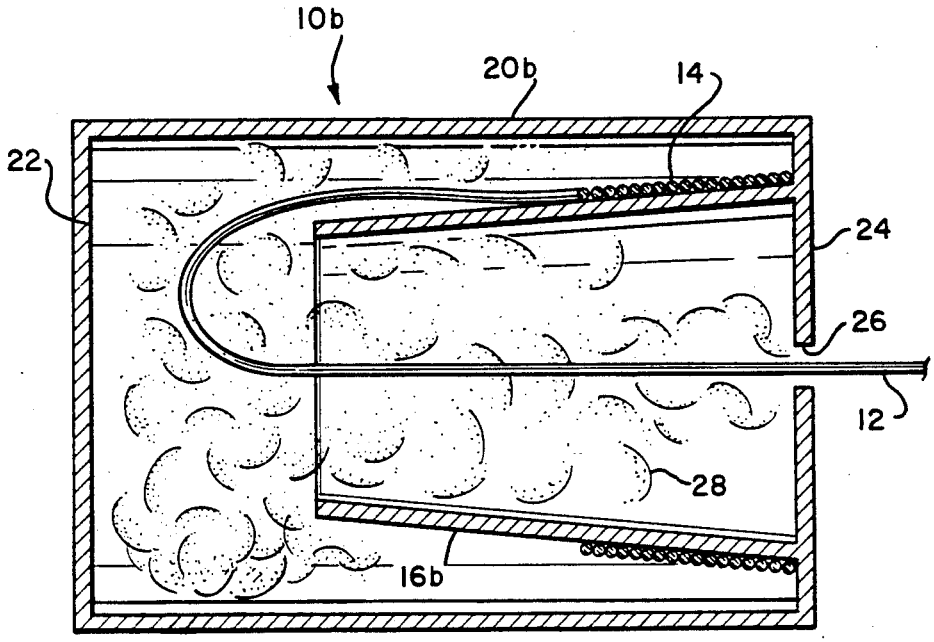
FIG. 3 is a side sectional view of yet another embodiment.

FIG. 3 shows an embodiment of a dispenser **10*b* in which the filament 12 is caused to reverse its direction on being taken off the drum 16*b* before passing from enclosure 20*b* through the eyelet 26. The embodiment of FIG. 3** is illustrated with a static damping gas atmosphere (as in FIG. 1), but a flowing damping gas atmosphere (as in FIG. 2) could be used instead.

Figure 4:
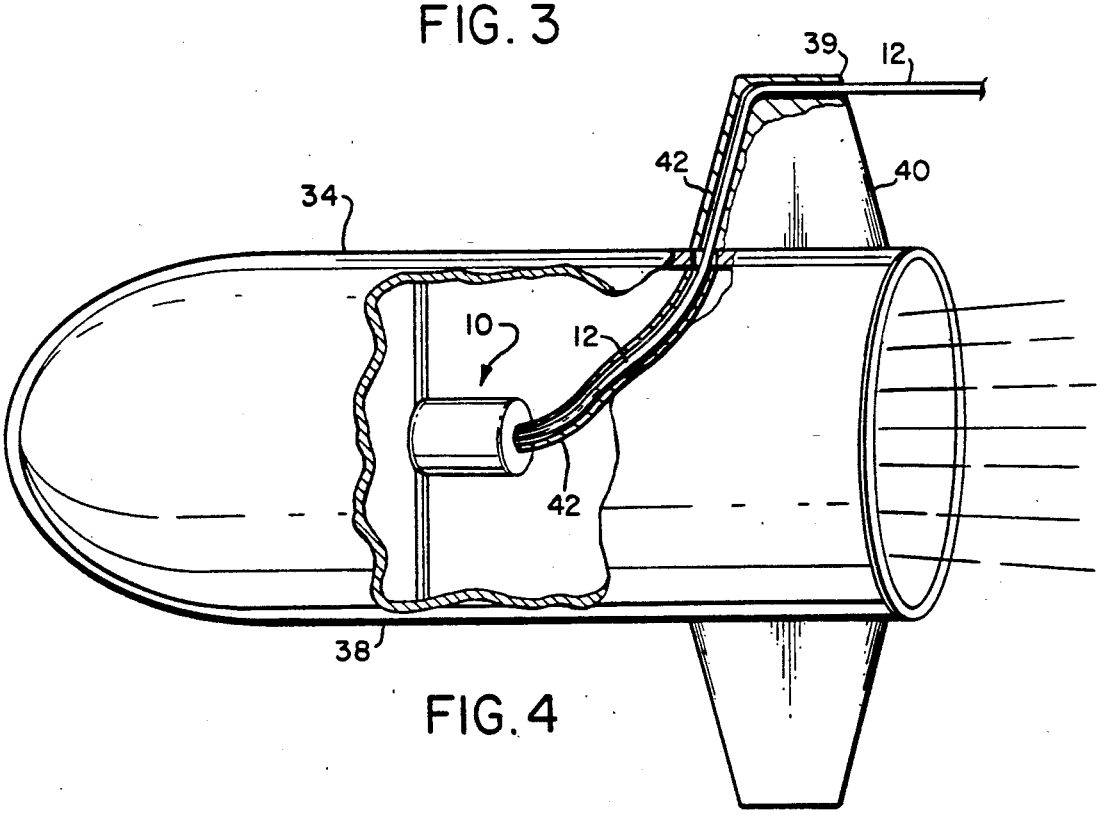
FIG. 4 is a perspective, partially fragmented view of a missile incorporating the invention.

FIG. 4 depicts general filament dispensing from a missile 34. As shown, the filament dispenser 10 (which may be any of the types and embodiments of FIG. 1–FIG. 3, or other in accordance with the invention) is located generally midships and the filament 12 extends outwardly from the missile for connection with apparatus at the launch site (not shown). In the particular embodiment of FIG. 4, the missile 34 has a body 38 and wings 40 which provide lift and also aid in stabilization and control of the missile 34. An engine or motor (not shown) is positioned within the body 38, with its exhaust directed out the rear of the body 38.

A duct 42 extends from the end wall 24 of the filament dispenser 10, through the interior of the body 38, and through one of the wings 40 to a filament release point 39 that is laterally separated from the exhaust gas. The interior of the duct 42 communicates with the interior of the dispenser 10 through the opening 26. The filament 12 passes from the dispenser 10, through the duct 42, and away from the missile 34. Ducting of the filament 12 to a release point that is laterally separated from the exhaust gas avoids damage to the filament 12 by the hot exhaust gas. The small diameter of the duct 42 also desirably restricts the outflow of the damping gas from the interior of the dispenser 10, thereby supporting a pressure differential between the interior of the dispenser 42 and the ambient atmosphere. The small amount of pressurized gas that does flow out the duct 42 to the ambient atmosphere serves to prevent the filament 12 from contacting the interior walls of the duct 42 and becoming damaged.

The present invention is also applicable to those missiles wherein the engine exhaust is not directed out the rear of missile. In either case, at launch the filament unwinds maintaining the interconnection for the required part of the flight path.

In the practice of the present invention the reduction of filament transverse oscillations acts ultimately to reduce air drag on the dispensing vehicle. Radar cross-section of the vehicle is also reduced. Since filament ducting is possible (e.g., via eyelet) dispensing in a manner to avoid the rocket plume is facilitated. As a result of such ducting, higher speed and longer range missions for the missile are made possible.

Although the present invention has been described in connection with a preferred embodiment, it is to be understood that modifications may be made that come within the spirit of the invention and within the scope of the appended claims. For example, instead of a single component aerosol or damping gas, multiple components may be used, certain ones of which provide other and different operational characteristics (e.g., lubricity). Mixtures of damping gases of varying STP densities permit even more precise tailoring of the damping characteristics of the dispenser.

What is claimed is:

1. Dispensing apparatus for filament wound onto a pack, comprising:

wall members defining a hollow enclosure within which the pack is fixedly mounted, one of the wall members having a single opening through which the filament passes on dispensing; and a quantity of a damping gas having an effective density of at least two times that of air at standard temperature and pressure filling the interior of the enclosure.

2. Dispensing apparatus as in claim 1, in which the enclosure is a hollow cylinder with the wound pack affixed to an inner circular end surface of the enclosure and the opening is formed in the opposite circular end surface.

3. Dispensing apparatus as in claim 1, in which the damping gas has an STP density of at least two times that of air.

4. Dispensing apparatus as in claim 1, in which the damping gas is sulfur hexafluoride.

5. Dispensing apparatus as in claim 1, in which the damping gas has a pressure of about one atmosphere.

6. Dispensing apparatus as in claim 1, in which the damping gas is maintained at a pressure of about one atmosphere.

7. Dispensing apparatus for filament wound onto a pack, comprising:

wall members defining a hollow enclosure within which the pack is fixedly mounted, one of the wall members having a single opening through which the filament passes on dispensing; and a quantity of a damping gas having an STP density of at least two times that of air at standard temperature and pressure filling the interior of the enclosure, the damping gas having a pressure of about one atmosphere.

8. Dispensing apparatus as in claim 7, in which the enclosure is a hollow cylinder with the wound pack affixed to an inner circular end surface of the enclosure and the opening is formed in the opposite circular end surface.

9. Dispensing apparatus as in claim 7, in which the pack is wound on the peripheral surface of a tapered cylindrical drum, the cylindrical axis of the drum being arranged generally parallel to the direction of filament dispense.

10. Dispensing apparatus as in claim 7, in which the pack is wound on the interior surface of a hollow cylindrical drum, the cylindrical axis of the drum being arranged generally parallel to the direction of filament dispense.

11. Dispensing apparatus as in claim 7, in which the damping gas is sulfur hexafluoride.

12. Dispensing apparatus for dispensing filament from a wound pack, comprising:

an enclosure for the wound pack including wall members having a single eyelet opening therein through which the dispensed filament passes;

a nozzle mounted in an enclosure wall member directed into the enclosure interior, the nozzle being arranged so that gas ejected from the nozzle being arranged so that gas ejected from the nozzle does not induce a swirling motion into the gas in the direction of the paying out of the optical fiber; and means for supplying a gas into the interior of the enclosure through the nozzle, the gas within the enclosure having an effective density of at least two times that of air at standard pressure and temperature.

13. Dispensing apparatus as in claim 12, in which the enclosure is a hollow cylinder with the wound pack affixed to an inner circular end surface of the enclosure and the opening is formed in the opposite circular end surface.

14. Dispensing apparatus as in claim 12, in which the pack is wound on the peripheral surface of a tapered cylindrical drum, the cylindrical axis of the drum being arranged generally parallel to the direction of filament dispense.

15. Dispensing apparatus as in claim 12, in which the pack is wound on the interior surface of a hollow cylindrical drum, the cylindrical axis of the drum being arranged generally parallel to the direction of filament dispense.

16. Dispensing apparatus as in claim 12, in which the damping gas is sulfur hexafluoride.

17. Dispensing apparatus as in claim 12, in which the damping gas has a pressure of about one atmosphere.

18. Dispensing apparatus as in claim 12, in which the damping gas is maintained at a pressure of about one atmosphere.

19. Dispensing apparatus as in claim 12, wherein the nozzle is directed in a direction such that gas which flows from the nozzle flows countercurrently to the helical motion of the filament as it unwinds from the wound pack.

20. Dispensing apparatus as in claim 12, wherein the enclosure is mounted within a missile.

* * * * *